US007001288B2

(12) United States Patent
Harrell

(10) Patent No.: US 7,001,288 B2
(45) Date of Patent: Feb. 21, 2006

(54) SOCCER PRACTICE CAGE

(76) Inventor: Bobby E. Harrell, 142 Murray Cir., West Monroe, LA (US) 71292

( * ) Notice: Subject to any disclaimer, the term of this patent is extended or adjusted under 35 U.S.C. 154(b) by 70 days.

(21) Appl. No.: 10/315,381

(22) Filed: Dec. 10, 2002

(65) Prior Publication Data

US 2004/0242349 A1 Dec. 2, 2004

Related U.S. Application Data

(60) Provisional application No. 60/343,924, filed on Jan. 2, 2002.

(51) Int. Cl.
*A63B 69/00* (2006.01)
*A01K 1/03* (2006.01)

(52) U.S. Cl. ..... 473/446; 473/422; 119/474; 119/452

(58) Field of Classification Search ..... 473/172, 473/411, 431, 432, 446, 471, 478; 273/395, 273/397, 400, 402, 408, 410; 472/92–94; 135/124, 125, 160, 159, 117; 52/106; 119/474
See application file for complete search history.

(56) References Cited

U.S. PATENT DOCUMENTS 1,131,210 A * 3/1915 Clark ..... 273/386
1,922,578 A * 8/1933 Fernandez ..... 273/126 R
1,933,159 A 10/1933 Butler
2,066,078 A * 12/1936 Schmeiser ..... 135/88.13
2,657,056 A * 10/1953 Sorteberg ..... 473/410
2,742,293 A * 4/1956 Davis ..... 473/188
3,333,373 A * 8/1967 Taylor et al. ..... 52/63
3,338,579 A * 8/1967 McKain ..... 273/127 R
3,740,892 A * 6/1973 Cox et al. ..... 43/100
3,784,199 A * 1/1974 Chmela ..... 273/398
3,996,706 A * 12/1976 Bomgaars ..... 52/71
4,039,189 A * 8/1977 Headrick et al. ..... 273/400
4,067,547 A * 1/1978 Peters ..... 256/23
4,640,061 A * 2/1987 Trumley ..... 52/71
4,699,386 A 10/1987 Carzino
4,809,988 A * 3/1989 Hunter ..... 273/400
4,940,232 A * 7/1990 Chen ..... 473/416
4,948,147 A * 8/1990 Pallanca ..... 273/402
5,048,845 A * 9/1991 Dunipace ..... 273/400
5,201,498 A * 4/1993 Akins ..... 256/26
5,221,243 A * 6/1993 Walker ..... 482/83
5,452,896 A 9/1995 Core
5,556,106 A 9/1996 Jurcisin
5,655,776 A * 8/1997 Kaulfuerst ..... 473/187
5,722,446 A * 3/1998 Zheng ..... 135/125
5,741,194 A * 4/1998 Simunek ..... 473/490
5,902,194 A 5/1999 Wade
5,946,850 A * 9/1999 Sarkisyan ..... 43/100
5,961,403 A 10/1999 Caruso (Continued)

FOREIGN PATENT DOCUMENTS

GB 2364920 A * 2/2002

*Primary Examiner*—Mitra Aryanpour
(74) *Attorney, Agent, or Firm*—R. Keith Harrison

(57) ABSTRACT

A soccer practice cage including an enclosure defining an enclosure interior and multiple ball openings provided in spaced-apart relationship with respect to each other in the bottom portion of the enclosure and communicating with the enclosure interior. In typical application, at least two players in the enclosure interior stand in front of respective ball openings, and each of the players attempts to kick a ball through the ball opening or openings of the other player or players.

14 Claims, 2 Drawing Sheets

U.S. PATENT DOCUMENTS 5,967,089 A * 10/1999 Allen ..... 119/474
6,073,587 A * 6/2000 Hill et al. ..... 119/474
6,092,792 A * 7/2000 Camara ..... 256/24
6,250,635 B1 * 6/2001 Chittenden ..... 273/400
6,264,572 B1 7/2001 Matheson et al.
6,499,498 B1 * 12/2002 Zheng ..... 135/125
2003/0029489 A1 * 2/2003 Zheng ..... 135/125
2003/0111102 A1 * 6/2003 Henley et al. ..... 135/125

* cited by examiner

SOCCER PRACTICE CAGE

CROSS-REFERENCE TO RELATED APPLICATIONS

This application claims the benefit of provisional application No. 60/343,924, filed Jan. 2,2002.

BACKGROUND OF THE INVENTION

Field of the Invention

This invention relates to an apparatus for sports training and more particularly, to a soccer practice cage including an enclosure defining an enclosure interior and multiple ball openings provided in spaced-apart relationship with respect to each other in the bottom portion of the enclosure and communicating with the enclosure interior. In typical application, at least two players in the enclosure interior stand in front of respective ball openings, and each of the players attempts to kick a ball through the ball opening or openings of the other player or players.

In recent years, soccer has become the world's most popular sport. In a soccer game, 11 players on each of two teams attempt to kick or hit a ball with their heads into the other team's goal, and the team that scores the most goals wins the game. A goalkeeper, or "goalie", stands guard in front of the team's goal area in an attempt to prevent the other team from kicking the ball into the goal and scoring.

Kicking, the most important skill in soccer, is used to put the ball into play, to "pass" the ball from one player to another, to "shoot" the ball at the goal, to propel the ball into a particular area of the field in order to achieve a desired field position, and to block a ball from entering a goal. A skilled soccer player can kick the ball accurately for short or long distances with either foot. Accordingly, those players who have acquired advanced kicking skills in the game of soccer enjoy a considerable competitive advantage over less skilled players.

Various apparatus are known in the art for enhancing a game player's accuracy in kicking, throwing or striking a ball. Patents of interest in this regard include U.S. Pat. Nos. 1,933,159; 4,699,386; 4,948,147; 5,452,896; 5,556,106; 5,902,194; 5,961,403; and 6,264,572.

SUMMARY OF THE INVENTION

The present invention relates to a soccer practice cage including an enclosure defining an enclosure interior and multiple ball openings provided in spaced-apart relationship with respect to each other in the bottom portion of the enclosure and communicating with the enclosure interior. In typical application, at least two players in the enclosure interior stand in front of respective ball openings, and each of the players attempts to kick a ball through the ball opening or openings of the other player or players.

BRIEF DESCRIPTION OF THE DRAWINGS

The invention will be better understood by reference to the accompanying drawings, wherein.

DESCRIPTION OF THE EMBODIMENTS

Figure 1:
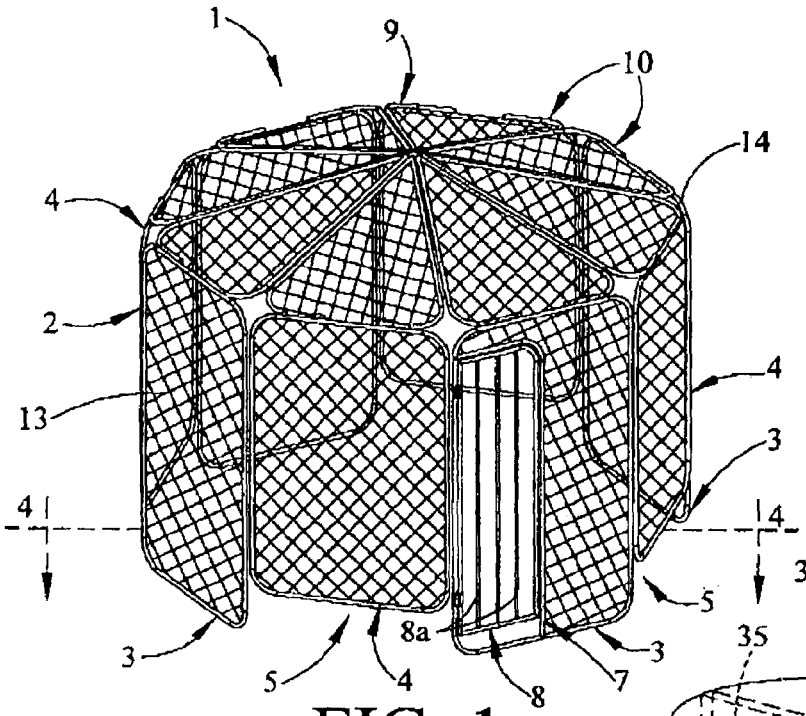
FIG. 1 is a perspective view of an illustrative embodiment of the soccer practice cage of this invention.
Figure 4:
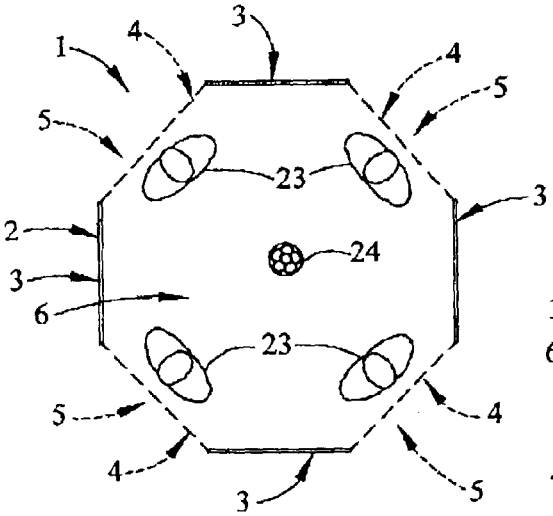
FIG. 4 is a top schematic view of an illustrative embodiment of the soccer practice cage, more particularly illustrating multiple player positions in typical application of the soccer practice cage.
Figure 5:
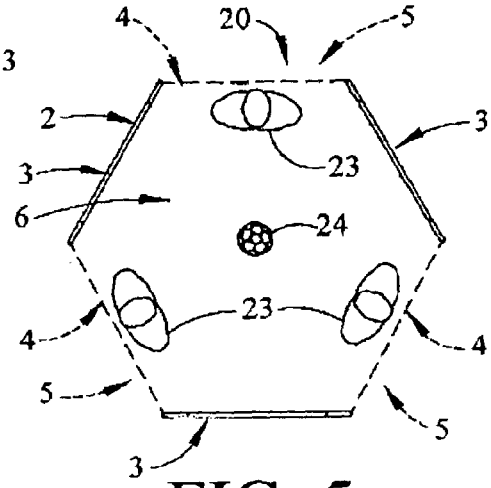
FIG. 5 is a top schematic view of another illustrative embodiment of the soccer practice cage, illustrating multiple player positions in typical application of the soccer practice cage.

Referring initially to FIGS. 1, 4 and 5 of the drawings, an illustrative embodiment of the soccer practice cage of this invention is generally illustrated by reference numeral 1. The soccer practice cage 1 includes a multi-sided enclosure 2, constructed of multiple support panels 3 and connecting panels 4 of selected height and width and provided in alternating relationship with respect to each other to define an enclosure interior 6 (FIG. 4). As illustrated in FIG. 1, the enclosure 2 may be provided with a canopy 9 constructed of multiple canopy panels 10, as hereinafter further described. Each support panel 3 is disposed at an angle with respect to the adjacent or flanking pair of connecting panels 4 of the enclosure 2. The support panels 3 are typically longer than the intervening connecting panels 4 and rest on a supporting surface (not illustrated), such that the bottom edges of the connecting panels 4 are disposed in a raised position with respect to the supporting surface to define a ball opening 5 of selected height and width between each pair of adjacent support panels 3. While the soccer practice cage 1 illustrated in FIGS. 1 and 4 has four support panels 3 and four connecting panels 4 to define an eight-sided enclosure 2, it is understood that the soccer practice cage 1 may have any desired number of support panels 3 and connecting panels 4 to define an enclosure 2 having any number of sides, such as the soccer practice cage 20 having the three support panels 3 and three connecting panels 4 which define the six-sided enclosure 2 illustrated in FIG. 5, in non-exclusive particular.

Referring next to FIG. 2 and again to FIG. 1 of the drawings, the enclosure 2 typically includes an enclosure frame 2*a*, having multiple, generally rectangular support panel frames 11 which alternate with generally rectangular connecting panel frames 12. The support panel frames 11 and the connecting panel frames 12 of the enclosure frame 2*a* define the supporting elements of the support panels 3 and the connecting panels 4, respectively, of the enclosure 2. Each of the support panel frames 11 typically includes a pair of parallel vertical segments 11*a*, a bottom segment 11*b* and a parallel top segment 11*c*. Each of the connecting panel frames 12 likewise typically includes a pair of parallel vertical segments 12*a*, a bottom segment 12*b* and a parallel top segment 12*c*. The vertical segments 11*a* of each support panel frame 11 are welded, bolted or otherwise attached to the vertical segments 12*a* of the respective adjacent connecting panel frames 12. The bottom segments 11*b* of the support panel frames 11 and the bottom segments 12*b* of the connecting panel frames 12 collectively define a lower edge of the enclosure 2, whereas the top segments 11*c* of the support panel frames 11 and the top segments 12*c* of the connecting panel frames 12 collectively define an upper edge of the enclosure 2. As further illustrated in FIG. 2, the top segments 12*c* of the respective connecting panel frames 12 may be flush with, or disposed at substantially the same height as, the top segments 11*c* of the respective support panel frames 11, to impart a substantially uniform height to the upper edge of the enclosure 2. The bottom segments 12*b* of the respective connecting panel frames 12 may be disposed at a higher position with respect to the bottom segments 11*b* of the respective support panel frames 11. Accordingly, when the bottom segments 11*b* of the respective support panel frames 11 rest on a supporting surface (not illustrated), the bottom segments 12*b* of the respective connecting panel frames 12 are spaced from the supporting surface to define the generally rectangular ball openings 5 in the lower edge of the enclosure 2, between the adjacent support panel frames 11, as illustrated in FIG. 1.

Figure 2:
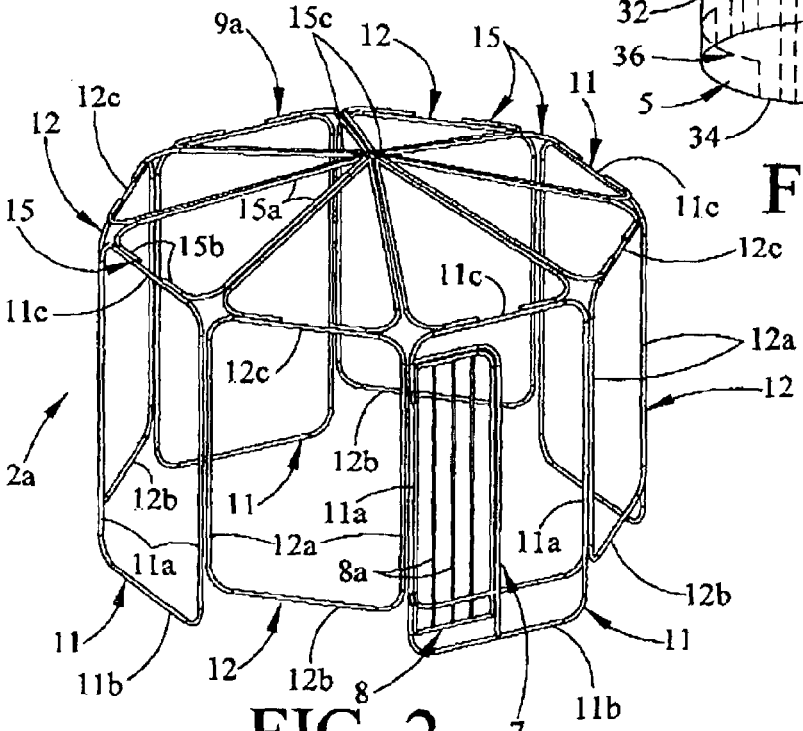
FIG. 2 is a perspective view of an enclosure frame and a canopy frame of an illustrative embodiment of the soccer practice cage of this invention.
Figure 6:
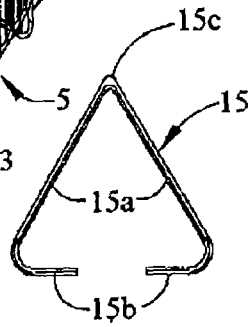
FIG. 6 is a top view of a canopy panel frame element of the soccer practice cage.

Referring next to FIG. 6 and again to FIGS. 1 and 2 of the drawings, the canopy 9 of the soccer practice cage 1 typically includes a canopy frame 9*a*, provided on the enclosure frame 2*a*. Accordingly, the canopy frame 9*a* typically includes multiple, generally triangular canopy panel frames 15 which define the supporting elements for the respective canopy panels 10 of the canopy 9. As particularly illustrated in FIG. 6, each canopy panel frame 15 may include a pair of side segments 15*a* joined to each other at an apex 15*c* and the diverging ends of which define a pair of inwardly-curved, facing bottom segments 15*b*. As illustrated in FIG. 2, the bottom segments 15*b* of each canopy panel frame 15 are welded, bolted or otherwise attached to the top segment 11*c* of each corresponding support panel frame 11 or to the top segment 12*c* of each connecting panel frame 12. Each side segment 15*a* of each canopy panel frame 15 is welded, bolted or otherwise attached to the corresponding side segment 15*a* of the adjacent canopy panel frame 15, and the apices 15*c* of the respective canopy panel frames 15 join each other at the center of the canopy frame 9*a*. While the canopy panel frames 15 illustrated in FIG. 2 angle upwardly from the respective support panel frames 11 and connecting panel frames 12, respectively, it is understood that the canopy panel frames 15 may extend horizontally from the support panel frames 11 and connecting panel frames 12 to define a generally planar canopy frame 9*a*. As further illustrated in FIGS. 1 and 2, a door frame 7 of selected size and configuration may be provided in the support panel frame 11 of one of the support panels 3, as illustrated, or in the connecting panel frame 12 of one of the connecting panels 4 of the enclosure 2, and a door 8, typically provided with multiple door bars 8*a* or a mesh, net, screen (not illustrated) or other covering, is hingedly mounted in the door frame 7 for the purpose of entering and exiting the enclosure interior 6 as hereinafter described.

Figure 3:
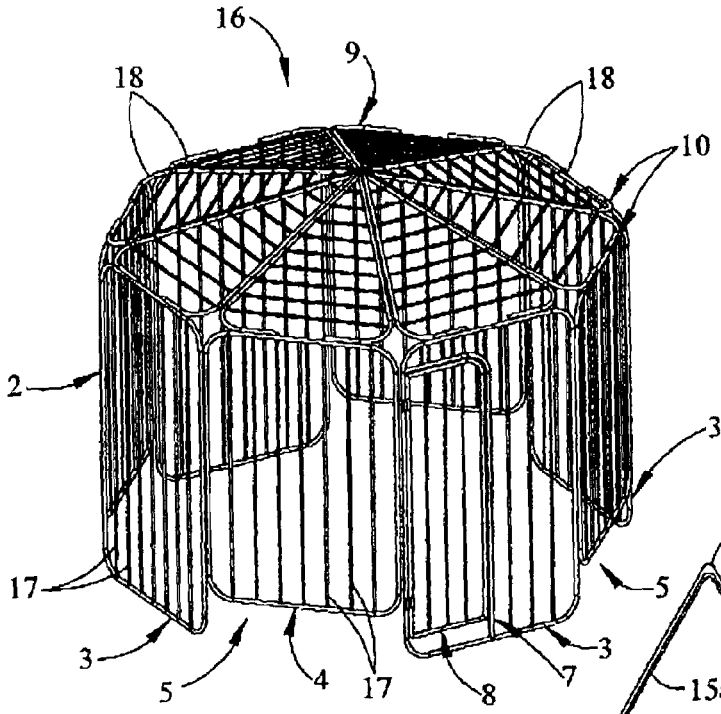
FIG. 3 is a perspective view of another illustrative embodiment of the soccer practice cage.

Referring next to FIG. 3 and initially to FIGS. 1 and 2 of the drawings, an enclosure net 13, typically constructed of nylon or other material, spans the frame elements of each support panel frame 11 and the frame elements of each connecting panel frame 12 of the enclosure frame 2*a* to define the support panels 3 and the connecting panels 4, respectively, of the enclosure 2, as illustrated in FIG. 1. In like manner, a canopy net 14 of selected material spans the frame elements of each of the canopy panel frames 15 of the canopy frame 9*a* to define the respective canopy panels 10 of the canopy 9, as further illustrated in FIG. 1. Alternatively, it is understood that the support panel frames 11 and the connecting panel frames 12 of the enclosure frame 2*a*, as well as the canopy panel frames 15 of the canopy frame 9*a*, may be fitted with a metal screen or meshwork (not illustrated) to define the support panels 3 and the connecting panels 4 of the enclosure 2 and the canopy panels 10 of the canopy 9, respectively. Still further in the alternative, in still another embodiment of the soccer practice cage generally indicated by reference numeral 16 in FIG. 3, the support panels 3 and the connecting panels 4 each includes multiple, parallel, closely-spaced enclosure bars 17 which may span the bottom segment 11*b* and top segment 11*c* of each support panel frame 11 and the bottom segment 12*b* and top segment 12*c* of each connecting panel frame 12 in a vertical orientation as illustrated in FIG. 3. The canopy panel frames 15 (FIG. 2) of the soccer practice cage 16 may be fitted with the canopy net 14 (FIG. 1) or a metal canopy mesh (not illustrated), or with multiple canopy bars 18, as further illustrated in FIG. 3, to define the respective canopy panels 10 of the canopy 9. While the enclosure bars 17 are shown disposed in a vertical, parallel orientation in the support panels 3 and the connecting panels 4 of the soccer practice cage 16 illustrated in FIG. 3, it is understood that either or both of the enclosure bars 17 and the canopy bars 18 may have other orientations in the support panel frames 11, the connecting panel frames 12 or the canopy panel frames 15, respectively, and may intersect each other in the respective support panel frames 11, connecting panel frames 12 and/or canopy panel frames 15 to define a grate or grid (not illustrated) of the enclosure bars 17 and/or canopy bars 18.

Referring again to FIGS. 4 and 5 of the drawings, in typical application of the soccer practice cage 1, 16, 20, multiple players 23 enter the enclosure interior 6 typically through the door 8 (FIG. 1) of the enclosure 2. In the case of the eight-sided soccer practice cage 1 heretofore described with respect to FIG. 1, each of the players 23 stands in the enclosure interior 6 and guards a ball opening 5, as illustrated in FIG. 4, with two of the players 23 standing directly opposite each other. A soccer ball 24 is placed in the center of the enclosure interior 6, and each of the players 23 attempts to kick the ball 24 through one of the other players' ball opening 5 as each of the players 23 guards his or her ball opening 5 to prevent the other players 23 from kicking the ball 24 through his or her ball opening 5. It will be appreciated by those skilled in the art that as few as two of the players 23 can stand in the enclosure interior 6 as each attempts to kick the ball 24 through the other's ball opening 5. Similarly, with regard to the six-sided enclosure 2 of the soccer practice cage 20 shown in FIG. 5, three of the players 23 typically stand in the enclosure interior 6 and guard the respective ball openings 5 to prevent the other players from kicking the ball 24 through each player's guarded ball opening 5. The canopy 9 (FIG. 1) prevents the ball 24 from being kicked over the upper edge of the enclosure 2.

Figure 7:
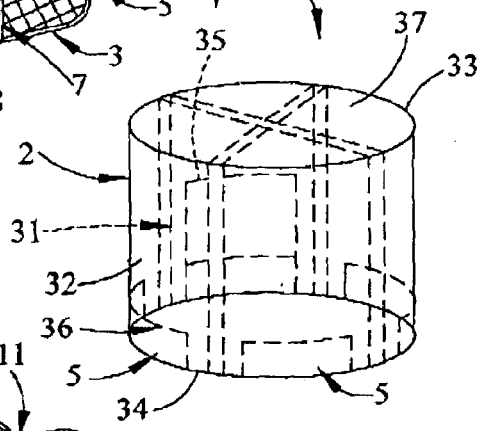
FIG. 7 is a perspective view of a cylindrical embodiment of the soccer practice cage of this invention.

Referring next to FIG. 7 of the drawings, in another embodiment of the soccer practice cage 30, the enclosure 2 has a cylindrical rather than a multi-sided configuration. The enclosure 2 includes a support frame 31 having a selected design and configuration and which supports a cover 32, which may be an enclosure net 13 (FIG. 1, a mesh or a plurality of enclosure bars 17 (FIG. 3). The enclosure 2 further includes an upper edge 33 and a lower edge 34, in which ball openings 5 are provided in the cover 32 along the lower edge 34 of the enclosure 2 at selected spacings with respect to each other. A door 35 is provided in the cover 32 for entering and exiting the enclosure interior 36 of the enclosure 2. A canopy 37 may be provided on the support frame 31 for closing the enclosure interior 36.

Referring again to FIGS. 1–3 and 5 of the drawings, it is understood that the soccer practice cage 1, 16, 20 may be constructed without the canopy 9 on the enclosure 2 under circumstances in which the support panels 3 and connecting panels 4 have a height substantial enough to prevent the ball 24 (FIG. 4) from being kicked over the sides of the enclosure 2 during use as heretofore described. It is further understood that the enclosure 2 can be constructed with any desired number and size of the support panels 3 and the connecting panels 4, other than the eight-paneled enclosure 2 of FIGS. 1, 3 and 4 or the six-paneled enclosure of FIG. 5. The enclosure frame 2*a* and the canopy frame 9*a* may be constructed of any durable material including polyvinylchloride (PVC) or other plastics, aluminum or steel, in non-exclusive particular. An enclosure bottom (not illustrated) may also be provided on the bottom edge of the enclosure 2, in which case the ball openings 5 are disposed between the upper surface of the enclosure bottom and the bottom edge of each connecting panel 4, defined by the bottom segment 12*b* (FIG. 2) of each connecting panel frame 12.

It will be appreciated by those skilled in the art that various alternative designs for the enclosure frame 2, other than the discrete support panel frames 11 and connecting panel frames 12 heretofore described with respect to FIG. 2, are possible. For example, the enclosure frame 2 may include multiple vertical support posts (not illustrated) spaced from each other around the perimeter of the enclosure frame 2*a*, with an enclosure net 13, mesh (not illustrated), parallel enclosure bars 17 or network or grate of the enclosure bars 17 spanning the support posts to define the alternating support panels 3 and connecting panels 4 of the enclosure 2. In that case, the enclosure frame 2 may be portable or alternatively, the support posts may be permanently fixed in the ground such as by concrete. It will be further appreciated by those skilled in the art that the canopy frame 9*a* of the canopy 9 may have numerous alternative configurations other than that heretofore described with respect to FIG. 2, and that the canopy frame 9*a* may be omitted from the enclosure frame 2*a*, in which case a single canopy net 14, a canopy mesh (not illustrated) or the multiple canopy bars 18 or a network or grate of canopy bars 18 may extend over the enclosure to close the enclosure interior 6. Referring again to FIG. 1 of the drawings, it is understood that the enclosure 2, the canopy 9 or both the enclosure 2 and the canopy 9 may be covered by a single large net instead of the discrete enclosure nets 13 for each of the support panels 3 and the connecting panels 4 and the discrete canopy nets 14 for each of the canopy panel frames 15. It will also be understood that the various features described above with respect to any of the embodiments of the soccer practice cage may be combined with the features of any other embodiment, where applicable.

While the preferred embodiments of the invention have been described above, it will be recognized and understood that various modifications can be made in the invention and the appended claims are intended to cover all such modifications which may fall within the spirit and scope of the invention.

I claim:

1. A soccer practice cage, comprising:

an enclosure comprising a plurality of support panels and a plurality of connecting panels provided in alternating relationship to each other around said enclosure, said support panels and connecting panels having a selected material and defining and enclosure interior, with adjacent ones of said plurality of support panels and said plurality of connecting panels disposed in angle relationship with respect to each other around said enclosure;

at least one door provided in at least one of said plurality of support panels or said plurality of connecting panels for allowing entry into said enclosure;

wherein said plurality of support panels and said plurality of connecting panels each has an upper edge and a lower edge; and wherein said lower edge of each of said plurality of support panels rests on a supporting surface and said lower edge of each of said connecting panels is raised with respect to said supporting surface, defining a ball opening between said lower edge of each of said plurality of connecting panels and said support surface;

wherein said plurality of panels is six panels or eight panels.

2. A soccer practice cage, comprising:

an enclosure comprising a plurality of support panels and a plurality of connecting panels provided in alternating relationship to each other around said enclosure, said support panels and connecting panels having a selected material and defining an enclosure interior, with adjacent ones of said plurality of support panels and said plurality of connecting panels disposed in angled relationship with respect to each other around said enclosure;

at least one door provided in at least one of said plurality of support panels or said plurality of connecting panels for allowing entry into said enclosure;

wherein said plurality of support panels and said plurality of connecting panels each has an upper edge and a lower edge;

wherein said lower edge of each of said plurality of support panels rests on a supporting surface and said lower edge of each of said connecting panels is raised with respect to said supporting surface, defining a ball opening between said lower edge of each of said plurality of connecting panels and said support surface;

wherein said selected material is a net, a mesh or a plurality of bars.

3. The soccer practice cage of claim 2 wherein said plurality of panels is six panels or eight panels.

4. The soccer practice cage of claim 1 further comprising a canopy provided on said enclosure.

5. The soccer practice cage of claim 4 wherein said plurality of panels is six panels or eight panels.

6. The soccer practice cage of claim 4 wherein said selected material is a net, a mesh or a plurality of bars.

7. The soccer practice cage of claim 6 wherein said plurality of panels is six panels or eight panels.

8. The soccer practice cage of claim 1 wherein said selected material is a net, a mesh or a plurality of bars.

9. A soccer practice cage, comprising:

an enclosure having a plurality of support panels and a plurality of connecting panels adjacent ones of which are disposed in angled relationship with respect to each other, said plurality of support panels and said plurality of connecting panels defining an enclosure interior;

a doorframe carried by at least one of said plurality of support panels or said plurality of connecting panels and a door carried by said doorframe for reversibly closing said enclosure;

wherein said plurality of support panels and said plurality of connecting panels each has an upper edge and a lower edge;

wherein said plurality of connecting panels define a plurality of ball openings between said lower edges of said plurality of connecting panels and a supporting surface, and wherein said lower edge of each of said plurality of support panels is adapted to rest on the supporting surface;

wherein said plurality of panels is six panels or eight panels.

10. A soccer practice cage, comprising:

an enclosure having a plurality of support panels and a plurality of connecting panels adjacent ones of which are disposed in angled relationship with respect to each other, said plurality of support panels and said plurality of connecting panels defining an enclosure interior;

a doorframe carried by at least one of said plurality of support panels or said plurality of connecting panels and a door carried by said doorframe for reversibly closing said enclosure;

wherein said plurality of support panels and said plurality of connecting panels each has an upper edge and a lower edge;

wherein said plurality of connecting panels define a plurality of ball openings between said lower edge of said plurality of connecting panels and a supporting surface, and wherein said lower edge of each of said plurality of support panels is adapted to rest on the supporting surface; and wherein said cover is an enclosure net, a plurality of enclosure bars or an enclosure mesh.

11. The soccer practice cage of claim 10 wherein said plurality of panels is six panels or eight panels.

12. The soccer practice cage of claim 10 wherein said enclosure comprises an enclosure frame and a cover provided on said enclosure frame.

13. The soccer practice cage of claim 10 further comprising a canopy provided on said enclosure.

14. The soccer practice cage of claim 13 wherein said enclosure has a generally cylindrical configuration.

* * * * *